US005909933A

United States Patent [19]

Keene et al.

[11] Patent Number: 5,909,933

[45] Date of Patent: Jun. 8, 1999

[54] ERGONOMIC ADJUSTABLE WORK SURFACE SYSTEM

[76] Inventors: Jeffrey C Keene, 136 East Ave., Freeport, N.Y. 11520; Alexander G. Markin, Jr., 1659 Rugby Rd., Merrick, N.Y. 11566

[21] Appl. No.: 09/017,270

[22] Filed: Feb. 2, 1998

[51] Int. Cl.[6] ..... A47B 51/00

[52] U.S. Cl. ..... 312/140.1; 312/228; 312/247; 312/312; 312/319.8

[58] Field of Search ..... 312/228, 319.5, 312/319.8, 349, 350, 312, 205, 246, 247, 140.1; 108/147.19; 11/147

[56] References Cited

U.S. PATENT DOCUMENTS

| | | | |
|---|---|---|---|
| 2,050,617 | 8/1936 | Litner | 312/228 |
| 3,416,849 | 12/1968 | Dube | 312/312 |
| 3,472,219 | 10/1969 | Roy et al. | 312/312 |
| 3,502,384 | 3/1970 | Gipson | 312/228 |
| 3,627,369 | 12/1971 | Miller | 312/312 X |
| 4,009,918 | 3/1977 | MacDonald et al. . | |
| 4,397,508 | 8/1983 | Bohnet et al. | 312/312 |
| 4,544,214 | 10/1985 | Nizel et al. | 312/228 X |
| 4,616,887 | 10/1986 | Oudman . | |
| 5,088,421 | 2/1992 | Beckstead | 312/312 X |
| 5,230,109 | 7/1993 | Zaccai et al. . | |
| 5,467,954 | 11/1995 | Wekell | 312/247 X |

FOREIGN PATENT DOCUMENTS

| | | | |
|---|---|---|---|
| 1429477 | 9/1969 | Germany | 312/247 |
| 632545 | 11/1949 | United Kingdom | 312/319.5 |
| 2061700 | 5/1981 | United Kingdom | 312/228 |
| 8910077 | 11/1989 | WIPO | 312/312 |

*Primary Examiner*—Peter M. Cuomo
*Assistant Examiner*—Hank V. Tran
*Attorney, Agent, or Firm*—Michael I. Kroll

[57] ABSTRACT

An ergonomic adjustable work surface system (12) comprising a cabinet (14) having a counter top (16) thereon. An assembly (18) is for setting the cabinet (14) in a height up and down movable manner against a wall (20) in a room (22) of a building (24). A facility (26) is for adjusting the height of the counter top (16) of the cabinet (14) with respect to a floor (28) in the room (22) of the building (24), so as to greatly reduce a lower back problem caused by an individual working in a standing position at the cabinet (14), by affording the individual easy height adjustment of the counter top (16) to ergonomically correspond to the individual's statue.

2 Claims, 7 Drawing Sheets

ERGONOMIC ADJUSTABLE WORK SURFACE SYSTEM

BACKGROUND OF THE INVENTION

1. Field of the Invention

The instant invention relates generally to workbenches and more specifically it relates to an ergonomic adjustable work surface system. The ergonomic adjustable work surface system will greatly reduce or completely eliminate lower back problems caused by individuals working in the standing position, by affording the worker the option of easily adjusting the height of the work area to ergonomically correspond to the individuals stature.

2. Description of the Prior Art

The majority of workbenches, counter tops, sinks and stoves in use today average between thirty three inches and thirty six inches in height, while not so with human beings. There can be no average calculated, as individuals have particular and varying postures which cannot be ergonomically standardized with their numerical vertical measurements. Even at an "average" five feet eleven inches, a person can find the simple task of washing a sink full of dishes uncomfortable, to say the least, as well as the task of preparing a dinner, notwithstanding. Experience with working for extended periods of time at a kitchen counter or sink that is too low for the individual involved, bears witness to the aching lower back that generally follows such a task.

Numerous workbenches have been provided in prior art that are sturdy tables at which manual work is done at fixed heights off of floors. While these units may be suitable for the particular purpose to which they address, they would not be as suitable for the purposes of the present invention as heretofore described.

SUMMARY OF THE INVENTION

A primary object of the present invention is to provide an ergonomic adjustable work surface system that will overcome the shortcomings of the prior art devices.

Another object is to provide an ergonomic adjustable work surface system in which its purpose or goal is to greatly reduce or completely eliminate lower back problems caused by individuals working in the standing position at counters, work benches, sinks, stoves, etc., by affording the worker the option of easily adjusting the height of his or her work area to ergonomically correspond to the individual's stature.

An additional object is to provide an ergonomic adjustable work surface system in which adjustment of height would be attained by a simple wall mounted electrically controlled, spring loaded toggle switch, that would have three positions: UP, STOP and DOWN. For safety purposes, the switch would return to its center, or STOP, position as soon as the user removes his or her finger from the switch. The raising and lowering of the work surface would be accomplished by the use of hydraulic pistons enclosed in telescoping legs, the number of which to be determined by the size, weight and work load of the particular surface. In other words, the system used for a mechanic working on an engine block would naturally require heavy duty hydraulic pistons as opposed to that of a housewife preparing her family's dinner.

At still additional object is to provide an ergonomic adjustable work surface system in which the use of the system in conjunction with stoves and sinks would be accomplished by incorporating plumbing and electrical connections which are totally flexible in nature, and would increase and decrease in span as the height of the work area changes.

A further object is to provide an ergonomic adjustable work surface system that is simple and easy to use.

A still further object is to provide an ergonomic adjustable work surface system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figures 1, 2:
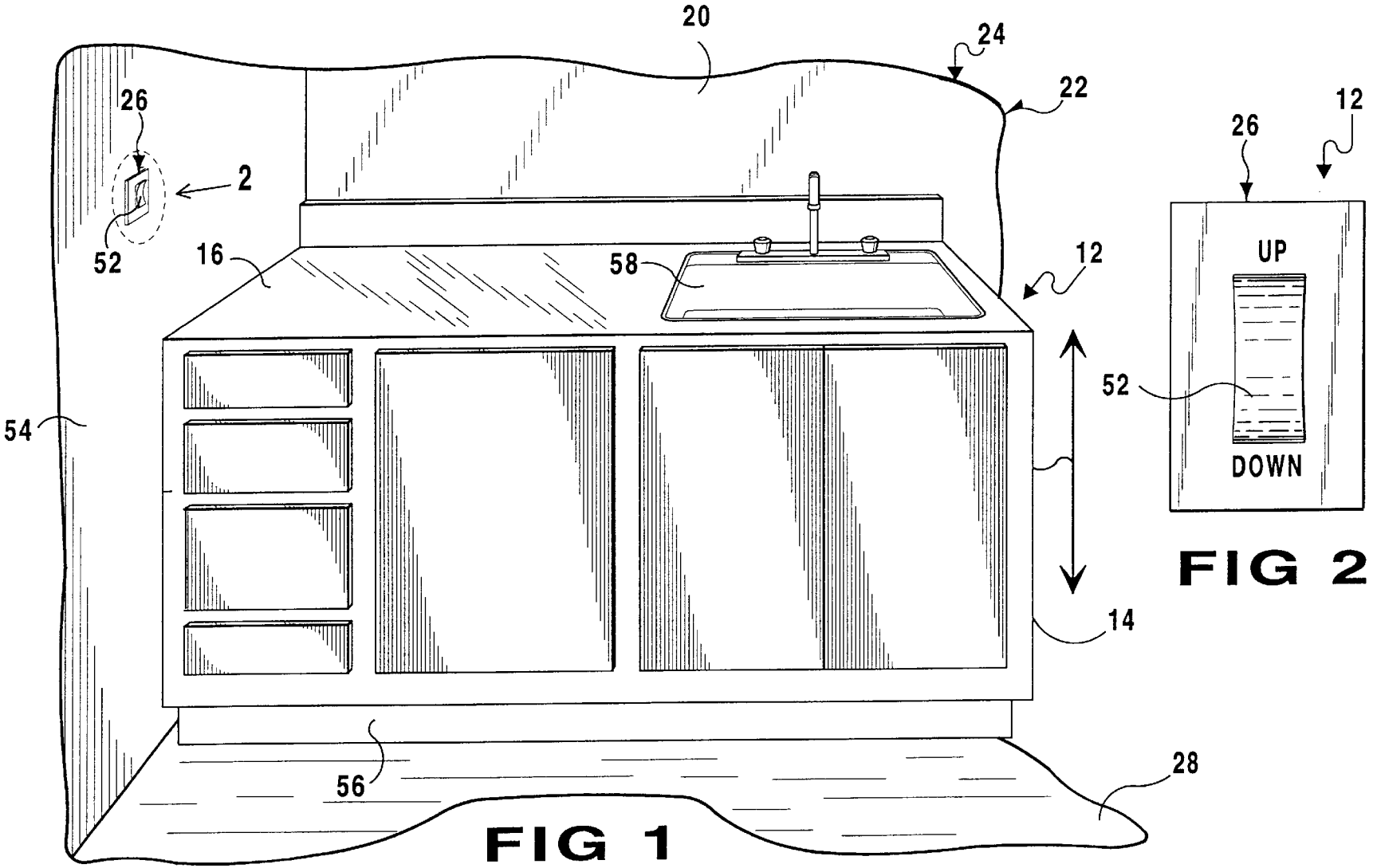
FIG. 1 is a front perspective view of the present invention being in a kitchen cabinet installed against a wall.
FIG. 2 is an enlarged front elevational view of the rocker switch as indicated by arrow 2 in FIG. 1.

Turning now descriptively to the drawings, in which similar reference characters denote similar elements throughout the several views, FIGS. 1 through 10 illustrate the present invention being an ergonomic adjustable work surface system 12. With regard to the reference numerals used, the following numbering is used throughout the various drawing figures.

12 ergonomic adjustable work surface system
14 cabinet of 12
16 counter top on 14
18 setting assembly of 12
20 wall in 22
22 room of 24
24 building
26 height adjusting facility of 12
28 floor in 22
30 rear guide track of 18
32 first bracket of 30
34 second bracket of 30
36 front telescopic guide leg of 18
38 upper segment of 36
40 lower segment of 36
42 hydraulic telescopic center leg of 26
44 top portion of 42
46 bottom portion of 42
48 hydraulic piston of 42 in 44 and 46
50 electrically operated hydraulic pump of 26
52 rocker switch
54 side wall in 22
56 free floating toe kick skirt
58 sink in 16
60 flexible plumbing connectors to 58

The ergonomic adjustable work surface system 12 comprises a cabinet 14 having a counter top 16 thereon. An assembly 18 is for setting the cabinet 14 in a height up and down movable manner against a wall 20 in a room 22 of a building 24. A facility 26 is for adjusting the height of the counter top 16 of the cabinet 14 with respect to a floor 28 in the room 22 of the building 24, so as to greatly reduce a lower back problem caused by an individual working in a standing position at the cabinet 14, by affording the individual easy height adjustment of the counter top 16 to ergonomically correspond to the individual's statue.

Figure 9:
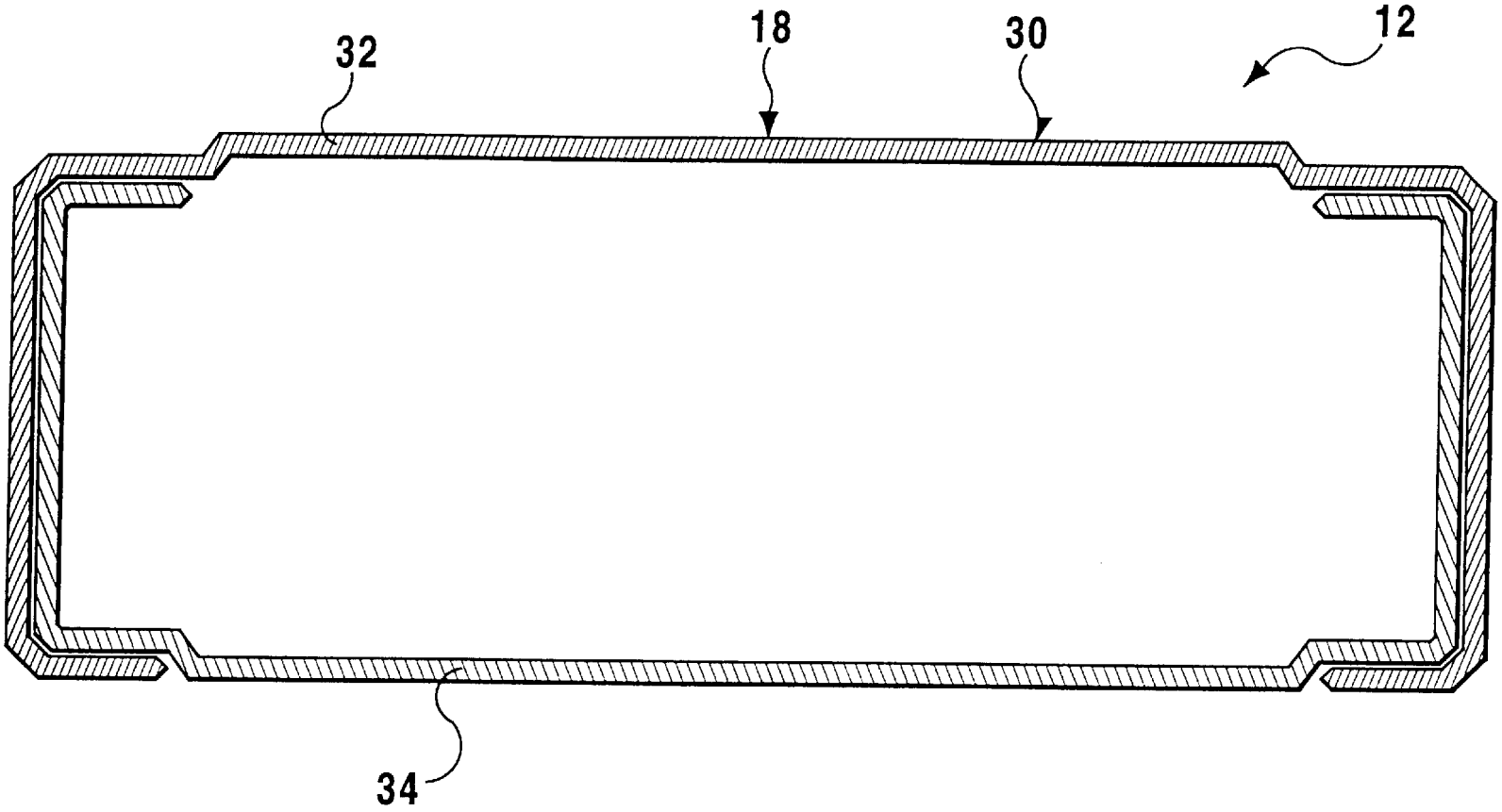
FIG. 9 is an enlarged cross sectional view of one of the rear guide tracks taken along line 9—9 in FIG. 4.
Figure 10:
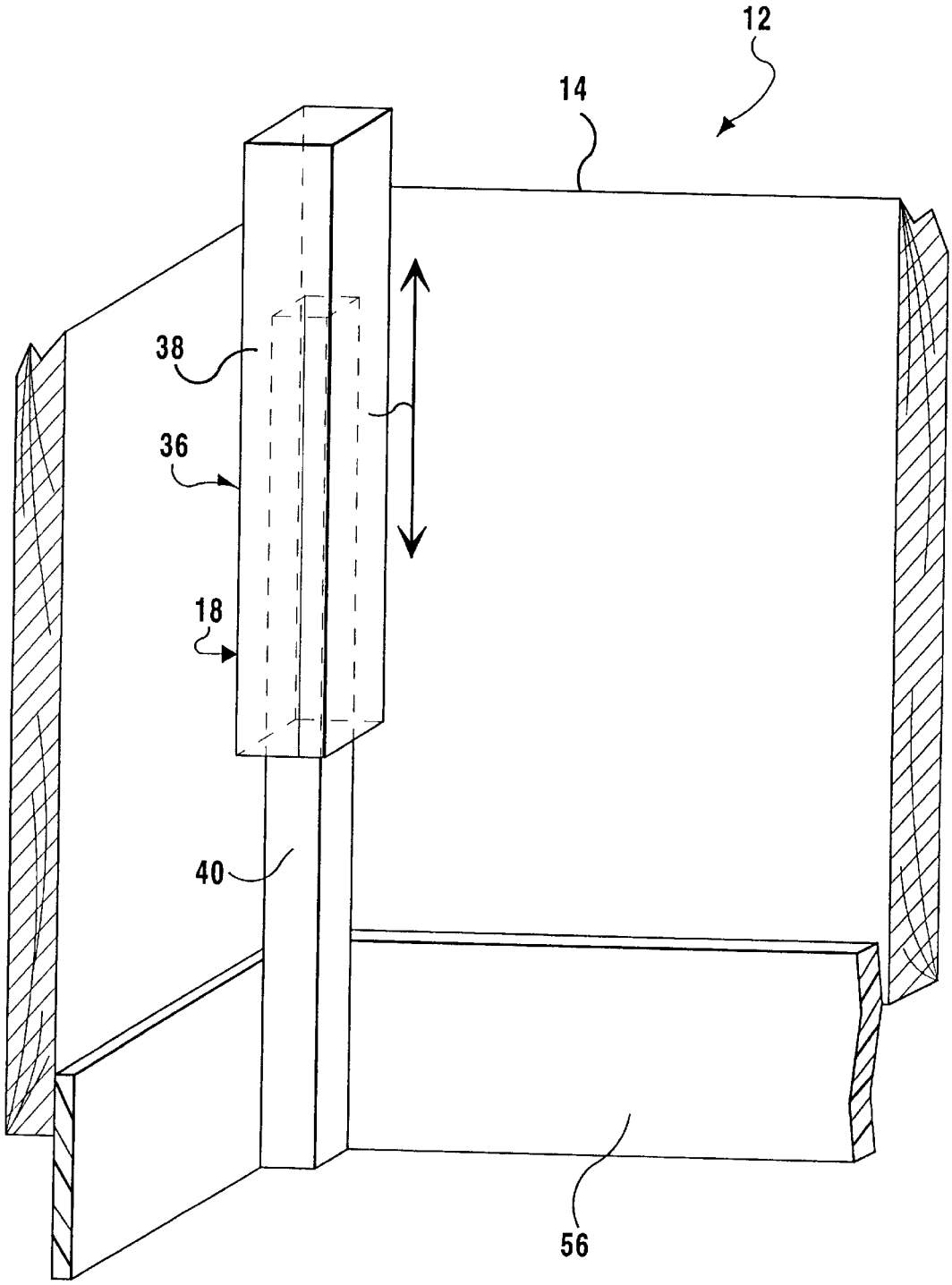
FIG. 10 is an enlarged perspective view of an interior portion of the kitchen cabinet, taken in the direction of arrow 10 in FIG. 4, showing the free floating toe kick skirt in greater detail.

The setting assembly 18 includes a pair of rear guide tracks 30 vertically spaced apart and mounted between the wall 20 in the room 22 of the building 24 and the back of the cabinet 14. Each rear guide track 30, as best seen in FIG. 9, consists of a first bracket 32 attached to the wall 20 in the room 22 of the building 24. A second bracket 34 is attached to the back of the cabinet 14, whereby the second bracket 34 slides vertically within the first bracket 32.

The setting assembly 18 also includes a pair of front telescopic guide legs 36. Each guide leg 36 is mounted in a vertical position within the cabinet 14 at a front corner thereof between the floor 28 in the room 22 of the building 24 and the counter top 16.

Figure 5:
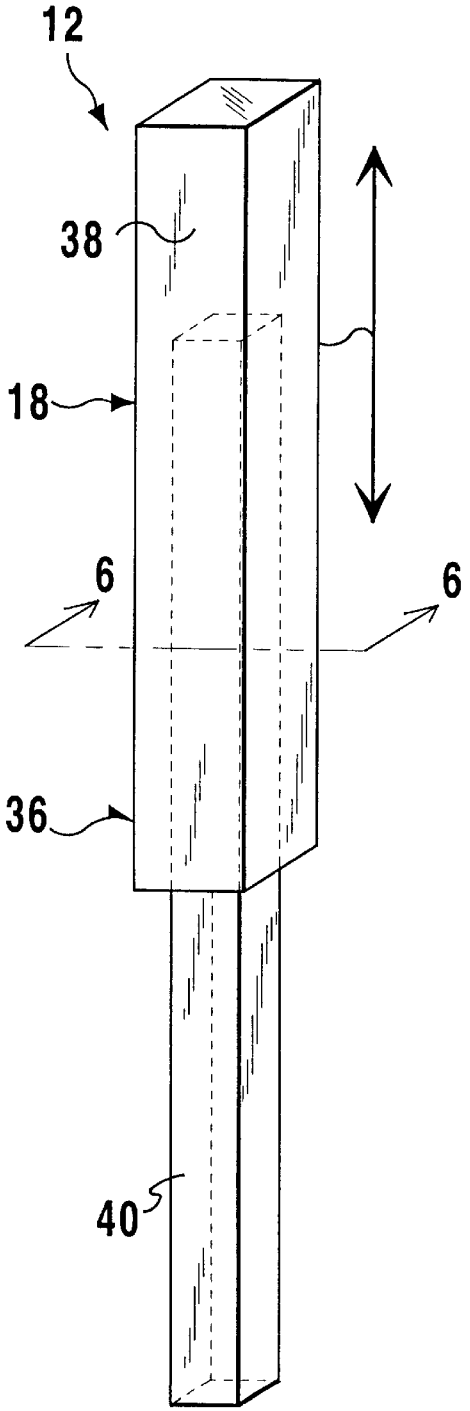
FIG. 5 is an enlarged perspective view of one of the front telescopic guide legs, as indicated by arrow 5 in FIG. 4.
Figure 6:
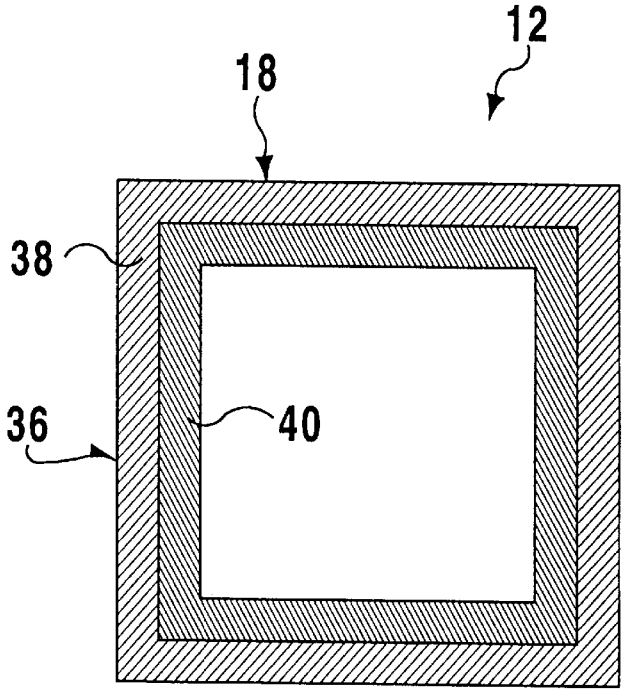
FIG. 6 is a further enlarged cross sectional view taken along line 6—6 in FIG. 5.
Figure 7:
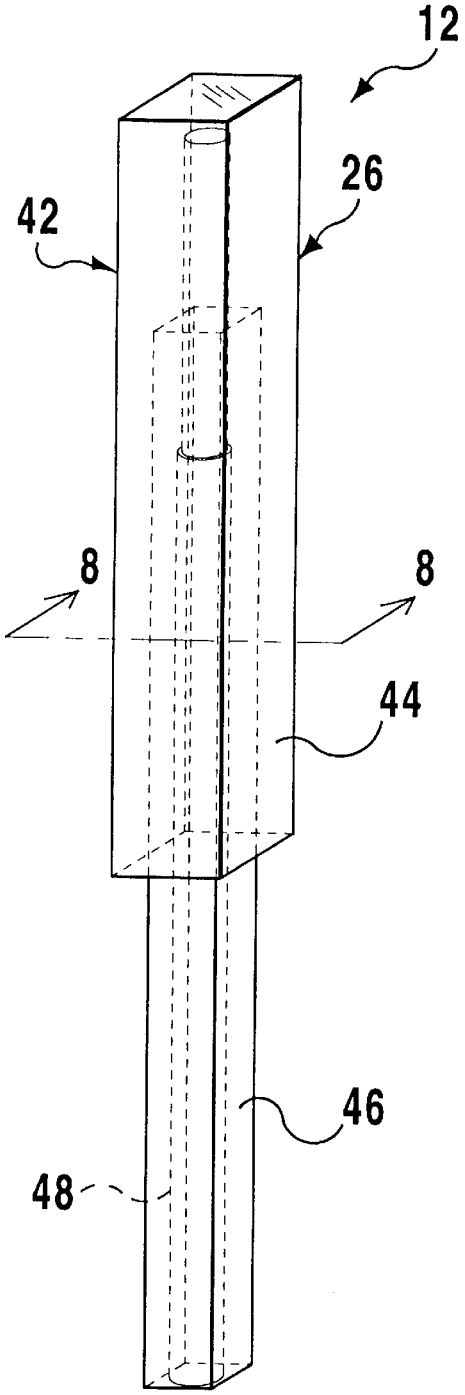
FIG. 7 is an enlarged perspective view of one of the hydraulic telescopic center legs as indicated by arrow 7 in FIG. 4.
Figure 8:
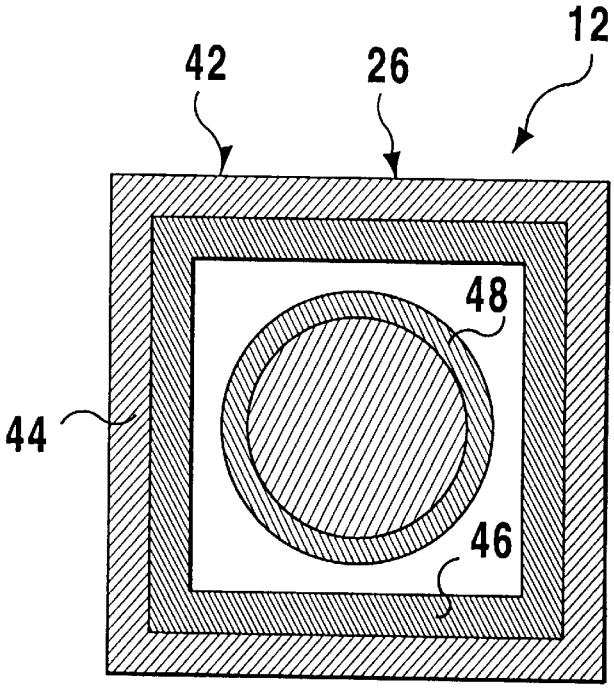
FIG. 8 is a further enlarged cross sectional view taken along line 8—8 in FIG. 7.

Each front telescopic guide leg 36, as best seen in FIGS. 5 and 6, comprises an upper segment 38 attached to the front corner within the cabinet 14 directly below the counter top 16. A lower segment 40 fits into and slides within the upper segment 38. The lower segment 40 has a bottom end which will always rest upon the floor 28 in the room 22 of the building 24.

The height adjusting facility 26 includes a pair of hydraulic telescopic center legs 42. Each center leg 42 is mounted in a vertical position within the cabinet 14 between the floor 28 in the room 22 of the building 24 and the counter top 16.

Each hydraulic telescopic center leg 42 consists of a top portion 44 attached at a top end to the counter top 16. A bottom portion 46 fits into and slides within the top portion 44. The bottom portion 46 has a bottom end which will always rest upon the floor 28 in the room 22 of the building 24. A hydraulic piston 48 extends within and between the top portion 44 and the bottom portion 46.

Figure 4:
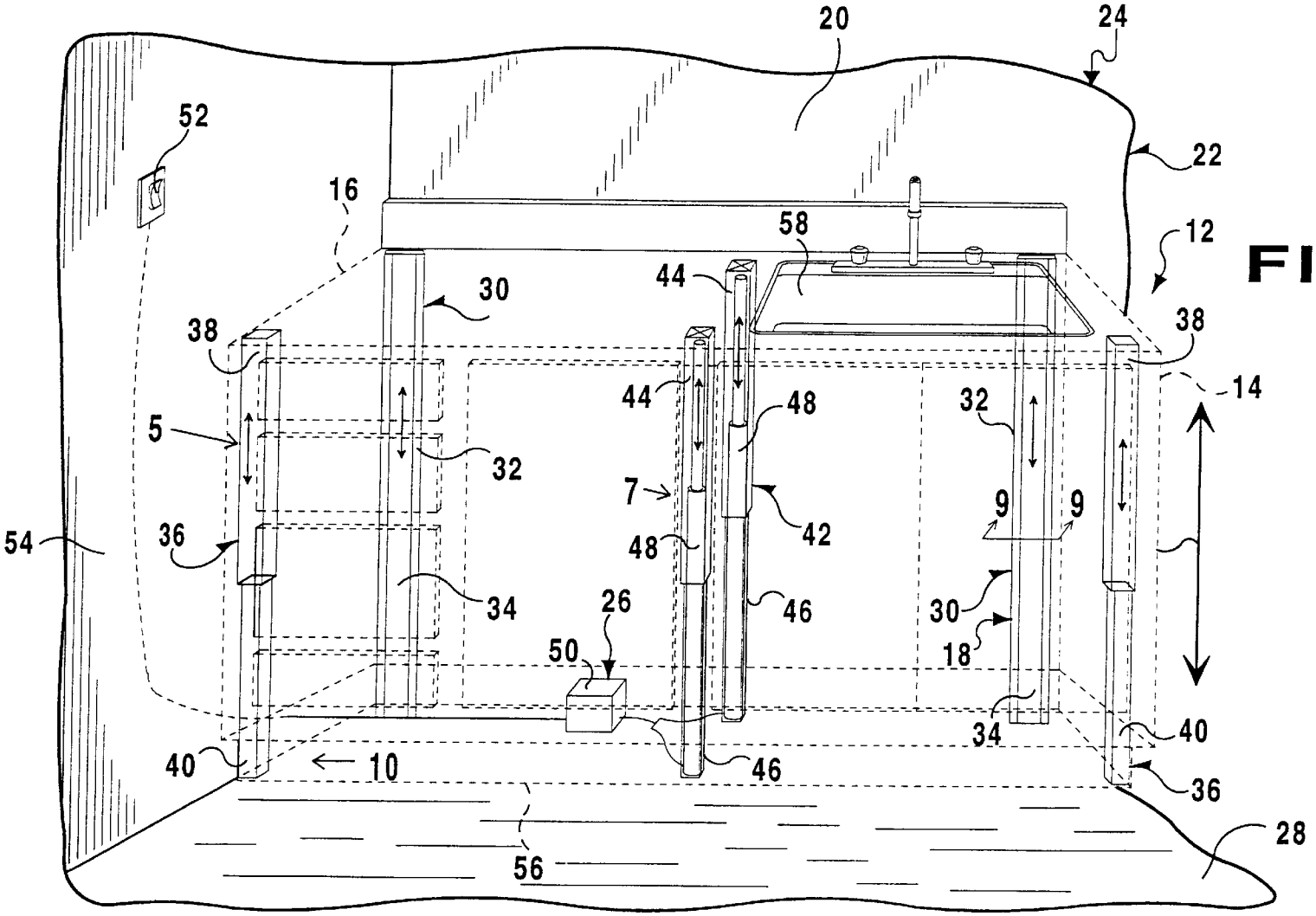
FIG. 4 is a front perspective view similar to FIG. 1, showing the kitchen cabinet in phantom to see the hydraulic telescopic center legs, the front telescopic guide legs and the rear guide tracks therein.

The height adjusting facility 26 further contains an electrically operated hydraulic pump 50 located within the cabinet 14 and is fluidly connected to each of the hydraulic pistons 48 (see FIG. 4). A rocker switch 52 is electrically connected to the hydraulic pump 50 and is located adjacent the cabinet 14 above the counter top 16 in a side wall 54 in the room 22 of the building 24. The rocker switch 52 has three positions, being UP, STOP and DOWN. For safety purposes the rocker switch 52 will return to the center STOP position when a person removes their finger from the rocker switch 52.

Figure 3:
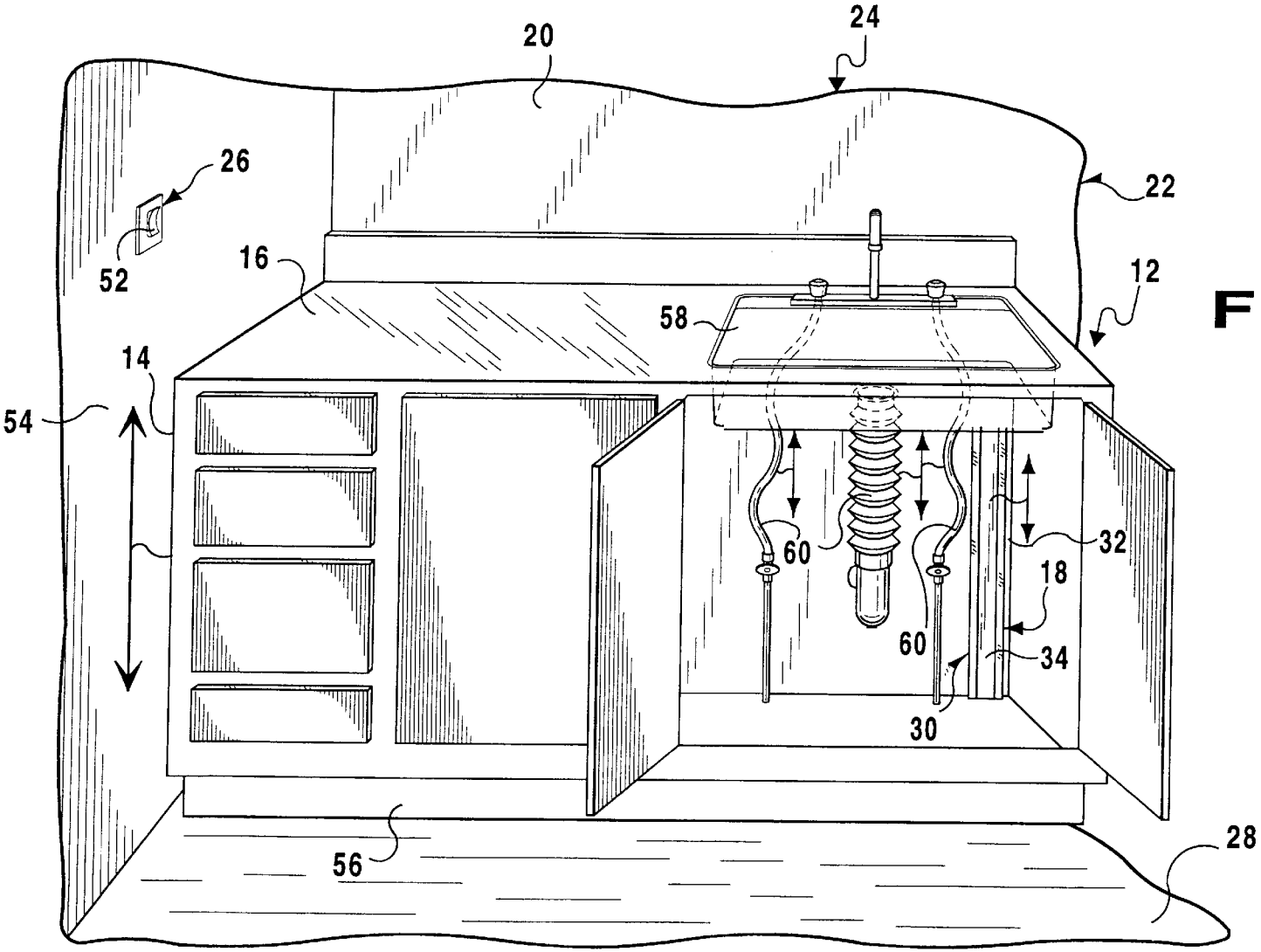
FIG. 3 is a front perspective view similar to FIG. 1, showing the kitchen cabinet doors opened to see the expanding and contracting plumbing lines, as well as one of the rear guide tracks therein.

The cabinet 14 includes a free floating toe kick skirt 56 about a lower perimeter thereof, to allow the cabinet 14 to appear as a permanent fixture regardless of what height it is set for at any given time. The cabinet 14, as shown in FIGS. 1, 3 and 4, can be equipped with a sink 58 mounted into the counter top 16. Flexible plumbing connections 60 are made to the sink 58, whereby the flexible plumbing connections 60 will increase and decrease in length, as the height of the counter top 16 changes.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An ergonomic adjustable work surface system comprising:

a) a cabinet having a counter top thereon;

b) means for setting said cabinet in a height movable manner against a wall in a room of a building comprising a pair of rear guide tracks vertically spaced apart and mounted between said wall and a back of said cabinet, each said rear guide track including a first bracket attached to said wall and a second bracket attached to the back of said cabinet, said second bracket sliding vertically within said first bracket;

c) a pair of front telescopic guide legs, each said guide leg mounted in a vertical position within said cabinet at a front corner thereof between the floor and said counter top, each said guide leg comprising an upper segment attached to said front corner within said cabinet directly below said counter top and a lower segment which fits into and slides within said upper segment, said lower segment having a bottom end which rests upon the floor;

d) means for adjusting the height of said cabinet at any level over the range of motion of said cabinet with respect to a floor in the room of the building comprising a pair of hydraulic telescopic center legs, one located toward the back of said cabinet between said guide tracks and the other one located toward the front of said cabinet between said front telescopic guide legs, each said center leg mounted in a vertical position within said cabinet between the floor and said counter top and having a top portion attached at a top end to said counter top, a bottom portion which fits into and slides within said top portion, said bottom portion having a bottom end which rests upon said floor, and hydraulic piston means extending within and between said top portion and said bottom portion for raising and lowering said cabinet;

e) an electrically operated hydraulic pump located within said cabinet fluidly connected to each of said hydraulic pistons;

f) rocker switch means electrically connected to said hydraulic pump adjacent said cabinet above said counter top mountable in a side wall of said room, said switch means having three positions, being UP, STOP, and DOWN, said rocker switch means returning to the STOP position when a person removes a finger from said switch means; and g) a free floating top kick skirt about a lower perimeter of said cabinet to allow said cabinet to appear as a permanent fixture regardless of what height the cabinet is set at any given time, the whole of said cabinet being vertically adjustable except for said legs and skirt remaining in contact with said floor.

2. An ergonomic adjustable work surface system as recited in claim 1, wherein said cabinet includes:

a) a sink mounted into said counter top; and b) flexible plumbing connections to said sink, whereby said flexible plumbing connections will increase and decrease in length as the height of said counter top changes.

* * * * *